US006772914B2

(12) United States Patent
Hubmann et al.

(10) Patent No.: US 6,772,914 B2
(45) Date of Patent: Aug. 10, 2004

(54) NON-REMOVABLE DEVICE FOR ATTACHING A DISPENSER TO A CONTAINER

(75) Inventors: Curtis H. Hubmann, Racine, WI (US); Matthew E. Young, Cambs (GB); Simon R. Gainey, Wayne, PA (US); Mark D. Gerhart, Westminster, MD (US)

(73) Assignee: JohnsonDiversey, Inc., Sturtevant, WI (US)

( * ) Notice: Subject to any disclaimer, the term of this patent is extended or adjusted under 35 U.S.C. 154(b) by 130 days.

(21) Appl. No.: 10/037,569

(22) Filed: Nov. 9, 2001

(65) Prior Publication Data

US 2003/0089741 A1 May 15, 2003

(51) Int. Cl.[7] ..... B67D 5/40
(52) U.S. Cl. ..... 222/153.09; 222/383.1
(58) Field of Search ..... 222/153.01, 153.09, 222/153.1, 383.1

(56) References Cited

U.S. PATENT DOCUMENTS

| | | | | | |
|---|---|---|---|---|---|
| 2,382,864 | A | | 8/1945 | Diaz | 215/30 |
| 2,673,655 | A | | 3/1954 | Greene | 215/22 |
| 3,255,930 | A | * | 6/1966 | Woodard | 222/180 |
| 3,412,937 | A | * | 11/1968 | Chamberlain | 239/142 |
| 3,938,550 | A | * | 2/1976 | Hechler, IV | 137/559 |
| 3,964,689 | A | * | 6/1976 | Horvath, Jr. | 239/318 |
| 3,977,557 | A | * | 8/1976 | Hazard | 215/274 |
| 4,345,691 | A | * | 8/1982 | Burke | 215/216 |
| 4,826,085 | A | * | 5/1989 | Chow et al. | 239/318 |
| 5,007,588 | A | * | 4/1991 | Chow et al. | 239/318 |
| 5,238,152 | A | * | 8/1993 | Maas et al. | 222/153.09 |
| 5,251,788 | A | * | 10/1993 | Moore | 222/111 |
| 5,320,288 | A | * | 6/1994 | Ketcham, Jr. | 239/316 |
| 5,372,310 | A | * | 12/1994 | Ketcham, Jr. | 239/317 |
| 5,544,810 | A | * | 8/1996 | Horvath, Jr. et al. | 239/10 |
| 5,873,496 | A | * | 2/1999 | Montaner et al. | 222/153.09 |

FOREIGN PATENT DOCUMENTS

| | | |
|---|---|---|
| EP | 0849000 A1 | 6/1998 |
| GB | 305719 | 2/1929 |
| GB | 1208490 | 10/1970 |
| WO | WO 0104006 A2 | 1/2001 |
| WO | WO 0104016 A1 | 1/2001 |

* cited by examiner

*Primary Examiner*—Joseph A. Kaufman
(74) *Attorney, Agent, or Firm*—Neil E. Hamilton; Warren R. Bovee; Renee J. Rymarz

(57) ABSTRACT

A device for a non-removably attaching a dispenser member to a container. A bracket member has a closure portion which engages a mouth of a container. The closure portion is connected to a body of the dispenser member. A fastening member engages the bracket and the mouth of the container. In a preferred manner the bracket member includes a locking member which is both frictionally connected and welded to the container.

27 Claims, 6 Drawing Sheets

NON-REMOVABLE DEVICE FOR ATTACHING A DISPENSER TO A CONTAINER

CROSS-REFERENCE TO RELATED APPLICATIONS

NONE

STATEMENT REGARDING FEDERALLY SPONSORED RESEARCH OR DEVELOPMENT

NONE

FIELD OF THE INVENTION

The present invention relates to a cap device and especially to a non-removably attached cap that attaches a dispenser to a container.

BACKGROUND OF THE INVENTION

Dispensers are regularly attached to a container through a variety of manners for a wide range of uses from chemicals to colognes. Typically they are attached through the standard means of male and female threading on the neck of the container and connecting device.

There are many other products on the market that use a connecting device that is non-removably attached but the manner in which they are attached can be circumvented or modified to allow the user to remove the dispenser and re-use it with other products or chemicals.

This ability to use a dispenser with a wide range of products or chemicals which it was not produced or designed for is not always advantageous or desirable for a dispenser. The use of a dispenser with the wrong product can cause a wide variety of problems from the failure of the dispenser to properly work to possible leaks or improper dispensing of a chemical that could cause injury to the individual who was using the product or some other individual.

The use of a locking mechanism to prevent the removal of a dispenser from a container or bottle has been frequently used but in most situations there are only one or two locking systems that work individually. This provides for some extent of protection but these systems can also be circumvented which may allow the end user to misuse a dispensing device.

The present invention is not only for the connection of a dispenser to a container but also has the added feature that the connecting device is attached in a non-removable fashion through the use of multiple locking mechanisms to protect the integrity of the entire system and the contents of the container. The use of a multiple locking mechanism in a synchronized manner does not allow the user to remove the dispenser because each different locking mechanism must be removed simultaneously in order to successfully remove the dispenser from the connecting device. If the end user does some how successfully accomplish removing the connecting device, the dispenser is no longer useable because the connecting device is destroyed. The destruction of the connecting device during removal eliminates the possibility of the end user misusing the dispenser, such as by refilling the unit with inappropriate solutions.

SUMMARY OF THE INVENTION

The present invention provides a connecting device for non-removably attaching a dispenser to a container. The connecting device is comprised of a bracket member and a closure portion adapted to engage the mouth of a container with the closure portion connected to a dispenser. The present invention further including a fastening member constructed and arranged to engage the bracket member and the mouth of a container.

The fastening member has threading on an internal side with at least one flange member. The bracket member includes a locking member with at least one extension member extending essentially perpendicular from the locking member. The locking member also includes at least one opening and has an internal side, which includes at least one guide member. The locking member also has an external side which has at least one flat raised surface.

The extension member that is connected to the locking member is also connected to a closure portion which is further connected to the dispensing member and has at least one pathway connecting through the closure portion and the dispensing member. The dispensing member has a spout member, a handle member and a housing member.

The fastening member is constructed and arranged to engage a bottle neck. The fastening member is also rotatably attached to the closure portion allowing the free attachment to the neck of a bottle. The bottle neck includes at least one locking protrusion to engage with the opening of the locking member further the bottle neck includes at least one guide protrusion which engages the guide member of the locking member. The bottle neck is threaded to engage with the threading on the internal side of the fastening member.

Another embodiment of the connecting device, which has all of the above stated features, further includes an additional fastening member. The additional fastening member has an external side which is engaged with the internal side of the fastening member. The internal side of the additional fastening member is engaged with the bottle neck, which is not threaded, in a non-removable manner. The additional fastening member has a bottom side which includes at least one tooth. It is engaged with at least one indentation on the bottom of the internal side of the fastening member.

DETAILED DESCRIPTION OF THE INVENTION

Figure 1:
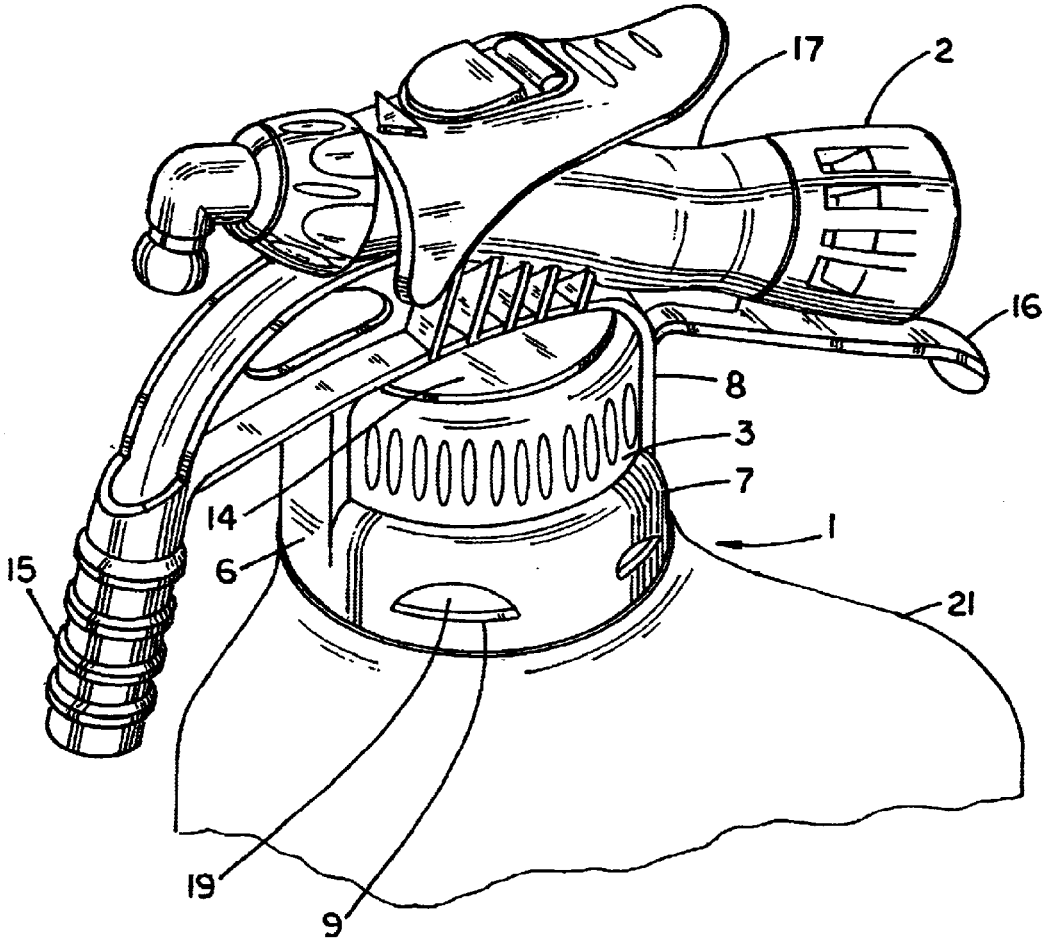
FIG. 1 is a perspective view of the connection device, connecting the dispensing member to the container neck.

The connection device generally 1 is shown in FIG. 1 connected to a bottle 21 with the fastening member 3 engaging the bottle. The bracket member 6 is fully engaged with a locking member 7 that is also attached to the bottle 21 with the locking protrusions 19 fully engaged in the opening 9. The extension members 8 extend from the locking member 7 and attach to the closure portion 14. The closure portion 14 is engaged with the fastening member 3 and dispenser member 2 which is comprised of a housing member 17, a spout member 15 and a handle member 16.

Figure 2:
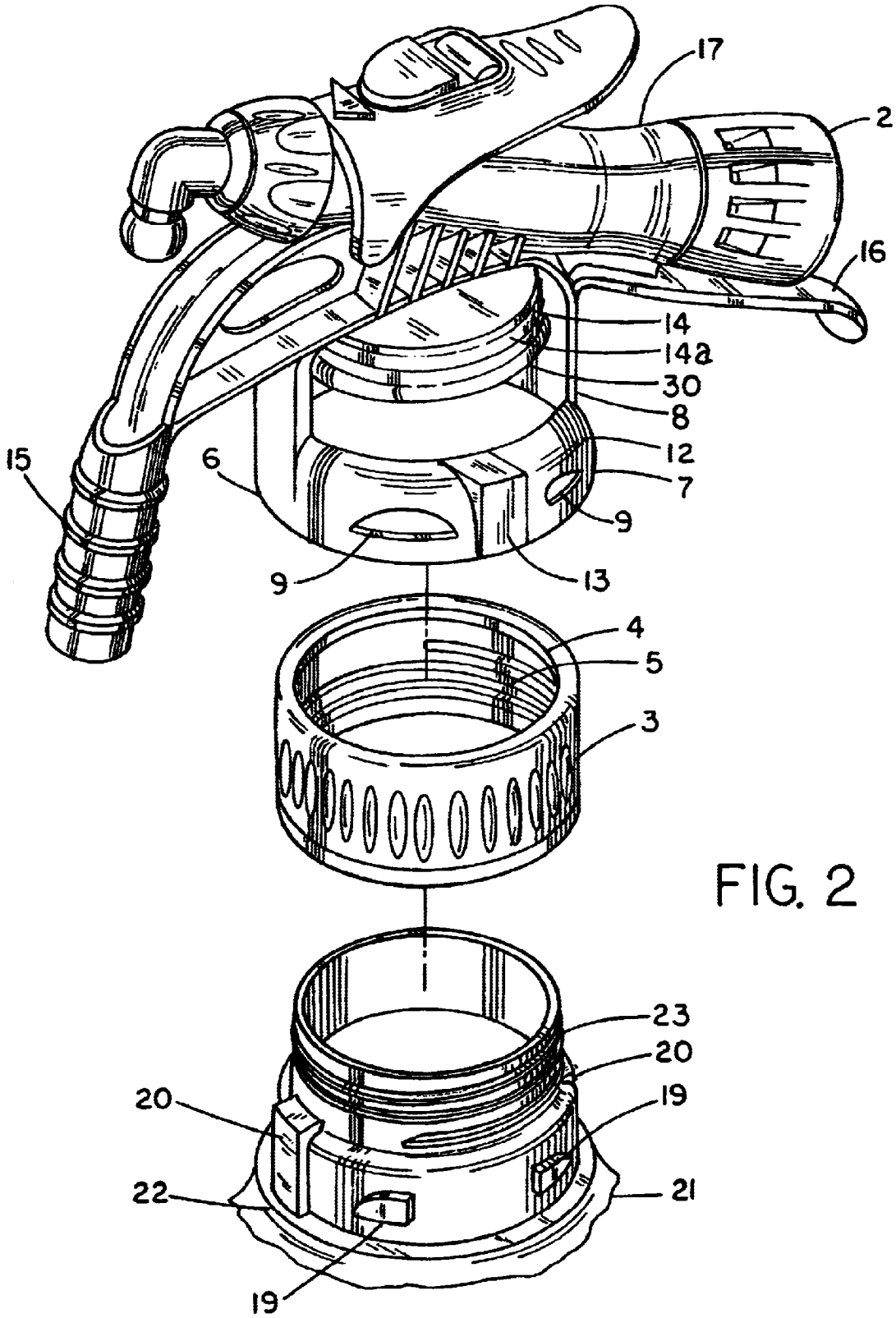
FIG. 2 is an exploded perspective view of one embodiment of the connection device, shown in FIG. 1.

As shown in FIG. 2 a bottle neck 22 has guide protrusions 20, locking protrusions 19 and bottle neck threads 23. The fastening member 3 has the flange member 4 providing an undercut for an interference but rotational connection with the ridge 14*a* in the closure portion 14. The closure portion 14 connects to the gasket member 30 provides a seal between the closure portion 14 and the bottle neck 22. There is also shown the indentations 26 and the fastening member threading 5 which engages bottle neck threads 23. The bracket member 6 includes the locking member 7 with its openings 9 which frictionally engage with the locking protrusions 19 in an interference manner. There is a flat raised surface 13 on the external side of the locking member 12 which can be welded to the bottle neck 22 and/or the fastening member 3 or bottle cap for increased security. In a preferred manner there are two diametrically opposed raised surfaces. The extension members 8 connect the locking member 7 and the closure portion 14, which is preferably a portion of the dispensing member 2 and connected thereto. The dispensing member 2 has a handle member 16, a spout member 15 and a housing member 17. A preferred dispenser member 2 is disclosed in commonly assigned U.S. patent application Ser. No. 09/956,294, filed Sep. 19, 2001 which teachings are incorporated herein by reference.

Figure 2A:
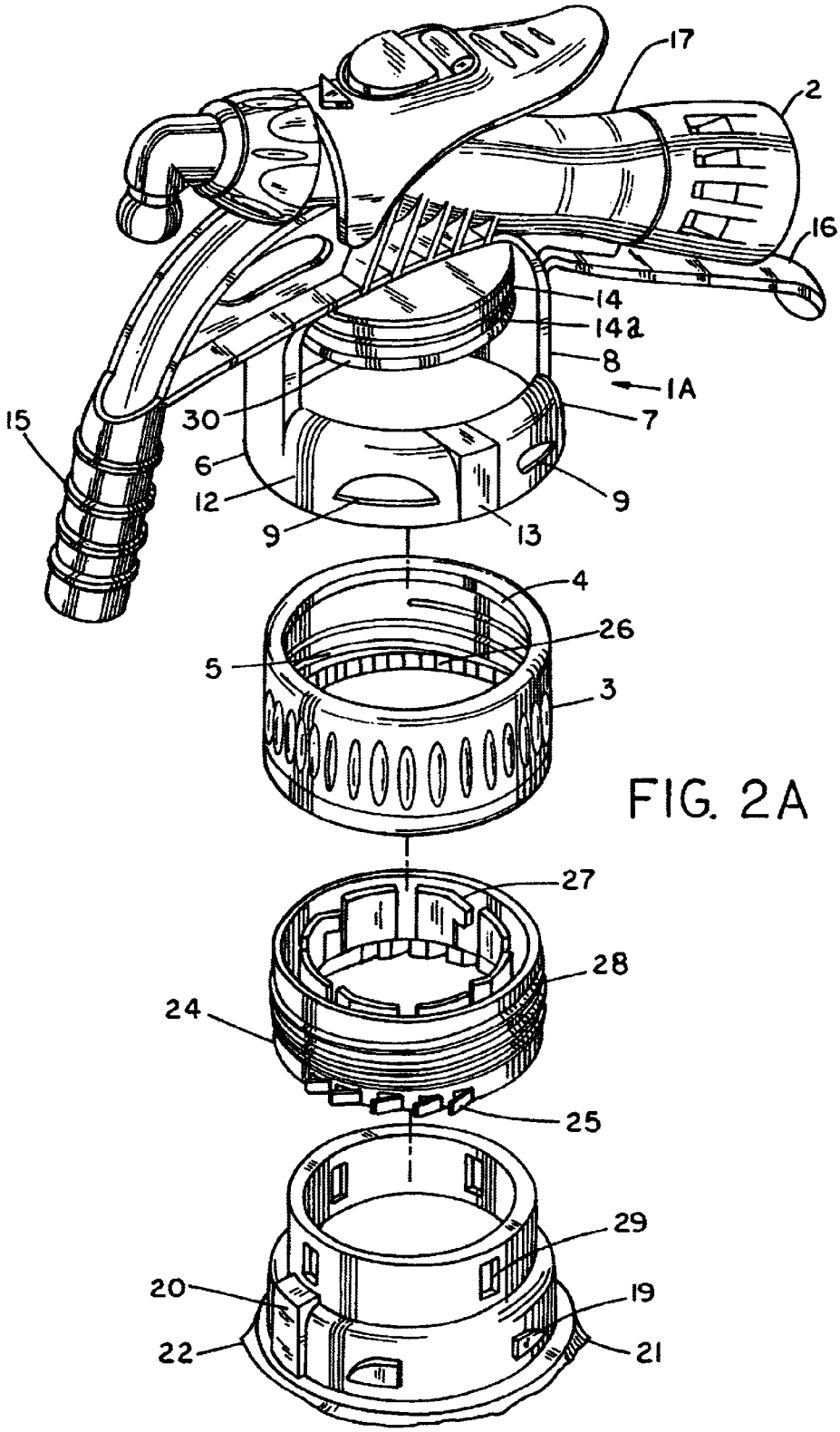
FIG. 2A is a view similar to FIG. 2 of a second embodiment of the connection device.

The embodiment 1A as shown in FIG. 2A includes a bottle neck 22 with guide protrusions 20 and locking protrusions 19. The additional fastening member 24 has teeth 25 on an external side. On the internal side of the additional fastening member 24 are the finger engaging portions 27 which attach into the grooves 29 of the bottle neck 22 in a non-removable fashion. The fastening member 3 has the flange member 4, the indentations 26 which engage with the teeth 25 of the additional fastening member 24 and the fastening member threading 5 which attaches to the threads 28 of the additional fastening member 24. The bracket member 6 has the locking member 7 with its openings 9 and its flat raised surface 13 on the external side of the locking member 12 which can be welded to the bottle neck 22 and/or the fastening member 3 for increased security. Locking member 7 is attached to bottle 21 in the same manner as described in the embodiment 1. The extension members 8 connect the locking member 7 and the closure portion 14, which attaches to the gasket member 30 to form a secure seal with the bottle neck 22. The closure portion is also connected to the dispenser member 2. The dispenser member 2 is the same as described in conjunction with FIGS. 1 and 2.

Figure 3:
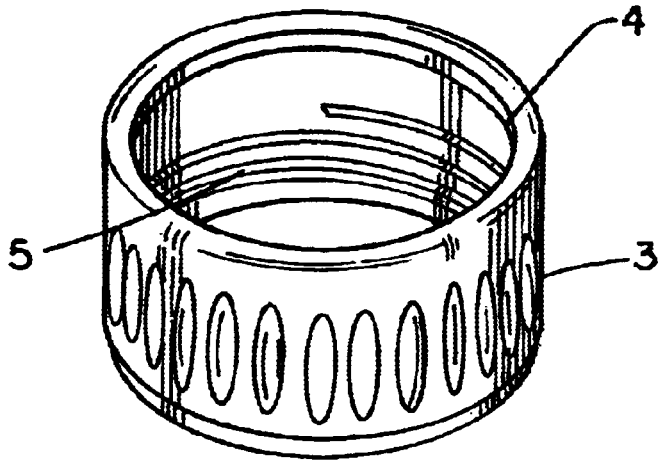
FIG. 3 is a perspective view of a fastening member employed in the connection device.
Figure 4:
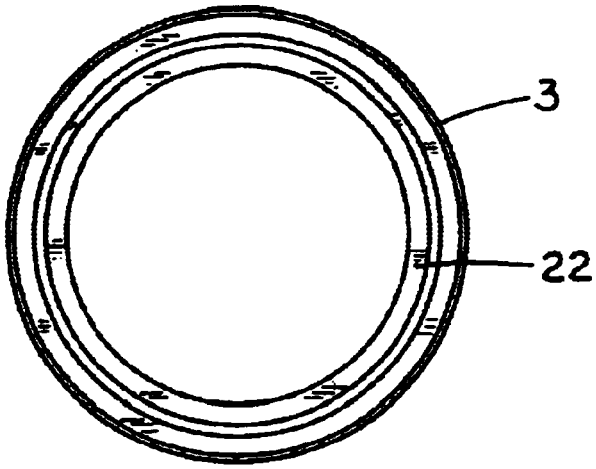
FIG. 4 is a bottom view of the fastening member.

The fastening member 3 is shown in FIG. 3 with the flange member 4 and the fastening member threading 5. The bottom view of the flange member 4 of the fastening member 3 is shown in FIG. 4 illustrating the bottle neck 22 fully engaged with the fastening member 3.

Figure 5:
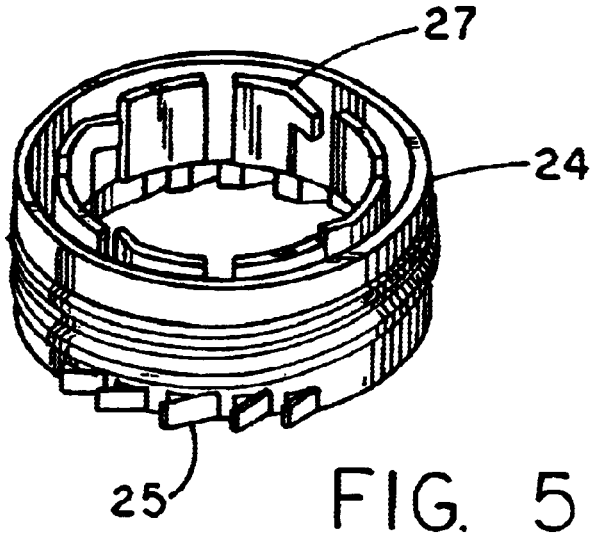
FIG. 5 is a perspective view of an additional fastening member employed in the second embodiment.
Figure 6:
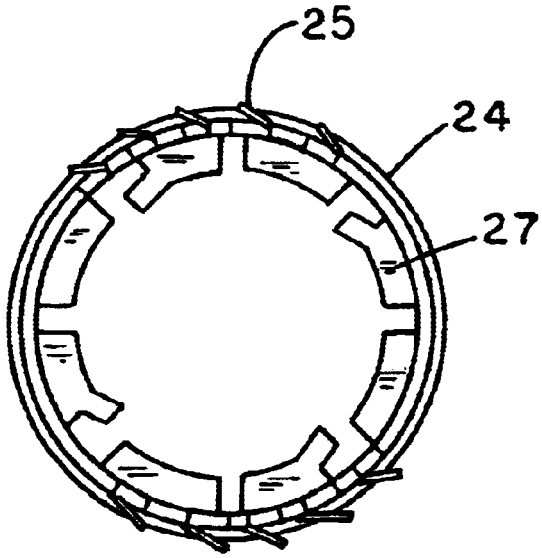
FIG. 6 is a bottom view of the additional fastening member.

The additional fastening member 24 is shown in FIGS. 5 and 6. It illustrates the internal finger engaging portions 27 and the external teeth 25.

Figure 7:
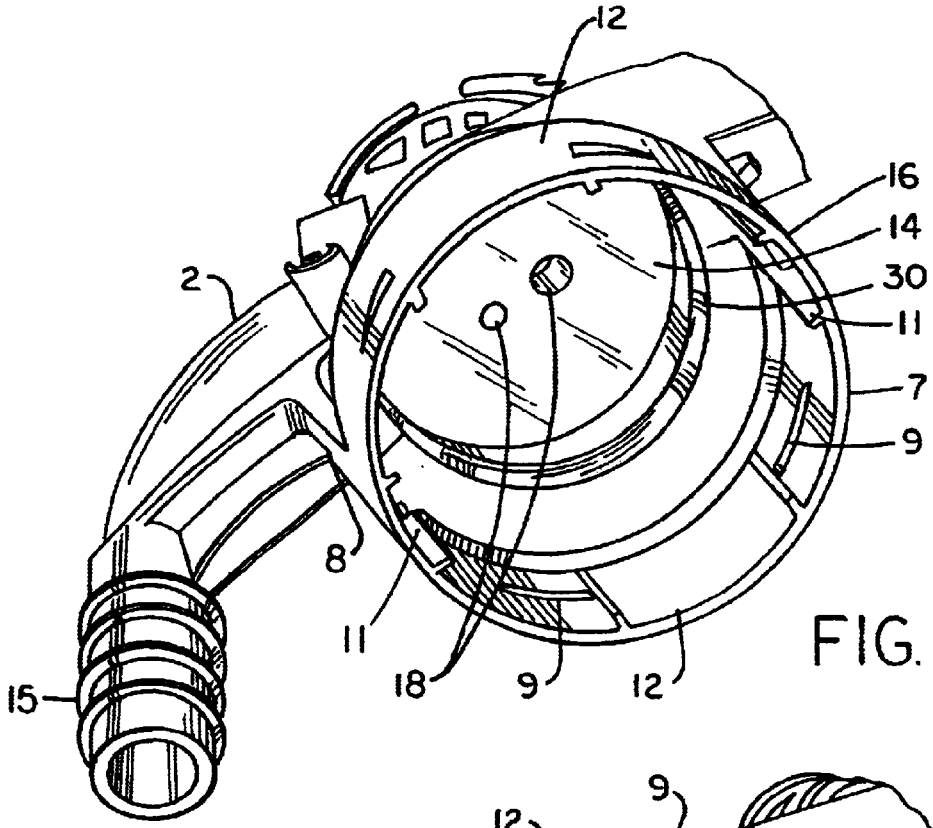
FIG. 7 is a bottom view of the connection device without the fastening member.
Figure 8:
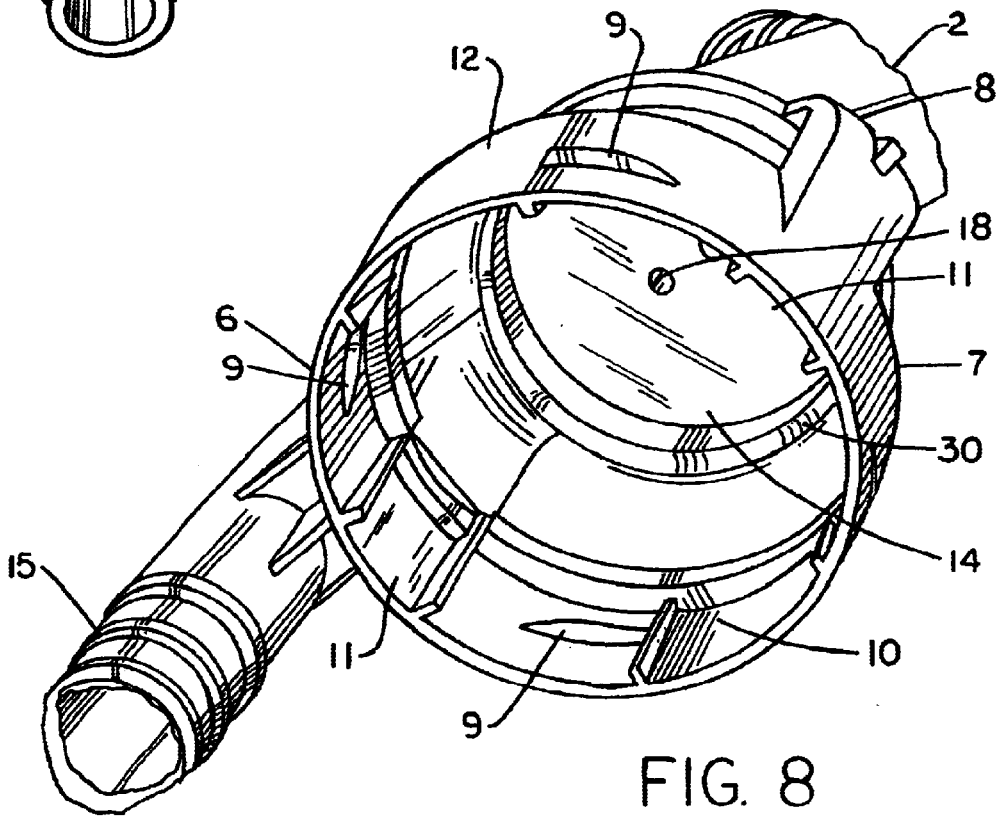
FIG. 8 is a view similar to FIG. 7 showing the guide member.

FIGS. 7 and 8 show the bracket member 6 without the fastening member 3 exposing the closure portion 14 and its pathways 18 which connect the dispenser member 2 and bottle 21. The internal side 10 of the locking member 7 also has the guide members 11, which engage the guide protrusions 20 (shown in FIG. 2).

Operation

Referring to embodiment 1, the dispensing member 2, the bracket member 6, the locking member 7, the sealing portion 14 and the extension member 8 are all assembled as one unit. The fastening member 3 is attached to the ridge 14*a* of the closure portion 14 with the ridge 14*a* engaging the undercut provided by the flange member 4 in a manner allowing the full rotation of said fastening member. Once the fastening member 3 is connected to the closure portion 14 and the gasket member 30 is in place the unit is joined with the bottle neck 22 wherein the fastening member threading 5 is engaged with the bottle neck threading 23. As the fastening member threading 5 is fully engaged with the bottle neck threading the guide member 11 is engaged with the guide protrusions 20 holding the unit in a proper position and the locking member 7 is in the proper position to allow the opening 9 to engage the locking protrusion 19. Once the fastening member 3 threading 5 and the bottle neck 22 threading 23 are fully engaged and the opening 9 and the locking protrusion 19 are fully engaged the unit is spot welded on the flat raised surface 13 securing the entire system and preventing any tampering.

In the alternative embodiment 1A the additional fastening member 24 is attached to the bottle neck 22 with the finger engaging portion 27 engaging with grooves 29 of the bottle neck 22 in a non-removable manner. The fastening member 3 is engaged with the additional fastening member 24 allowing the unit to be assembled as stated above additionally allowing the teeth 25 of the additional fastening member 24 to be fully engaged with the indentations 26 of the fastening member 3.

While only a limited number of embodiments of the present invention have been here described in the preceding figures, it will be apparent that many variations may be made, all within the scope of the present invention as defined in the following claims.

We claim:

1. A device for non-removably attaching a dispenser to a container comprising:

a bracket member including a closure portion adapted to engage a mouth of a container, the closure portion connected to a body of a dispenser, and at least one extension member extending essentially perpendicular from the bracket member; and the bracket member including a locking member; and a fastening member constructed and arranged to engage the bracket member and the mouth of a container.

2. The device of claim 1 wherein the fastening member has an internal side and at least one flange member.

3. The device of claim 2 wherein the fastening member has threading on the internal side.

4. The device of claim 3 wherein the locking member secures the bracket member to the container.

5. The device of claim 4 wherein the locking member has a: least one opening.

6. The device of claim 5 wherein locking member has an internal side and includes at least one guide member.

7. The device of claim 6 wherein the locking member has an external side and includes at least one flat raised surface.

8. The device of claim 7 wherein the extension member is connected to the closure portion.

9. The device of claim 8 wherein a dispensing member is attached to the closure portion.

10. The device of claim 9 wherein the dispensing member has a spout member, a handle member and a housing member.

11. The device of claim 10 wherein the closure portion has pathways connected to the body of the dispenser member.

12. The device of claim 11 wherein the fastening member is attached to the closure portion in an interference manner.

13. The device of claim 12 wherein the closure portion is engaged with a gasket member that engages the bottle neck.

14. The device of claim 13 wherein the fastening member is constructed and arranged to engage a bottle neck.

15. The device of claim 14 wherein the bottle neck includes at least one locking protrusion to engage with the opening of the locking member.

16. The device of claim 15 wherein the bottle neck includes at least one guide protrusion.

17. The device of claim 16 wherein the guide protrusion engages the guide member of the locking member.

18. The device of claim 17 wherein the bottle neck is threaded to engage with the threading on the internal side of the fastening member.

19. The device of claim 17 further includes an additional fastening member.

20. The device of claim 19 wherein an external side of the additional fastening member is engaged with the internal side of the fastening member.

21. The device of claim 20 wherein an internal side of the additional fastening member is engaged with the bottle neck in a non-removable manner.

22. The device of claim 21 wherein the internal side of the additional fastening member has a finger engaging portion.

23. The device of claim 22 wherein the finger engaging portion engage a groove on the bottle neck.

24. The device of claim 23 wherein a bottom side of the additional fastening member includes at least one tooth.

25. The device of claim 24 wherein the tooth is engaged with at least one indentation on a bottom side of the internal side of the fastening member.

26. A device for non-removably attaching a dispenser adapted to be connected with a bottle, the bottle having a threaded neck, a fastening member threadably attached to the bottle neck, the fastening member attached to a bracket member including a closure portion attached to a dispensing member on a top side of the closure portion and the closure portion having at least one pathway connected to the dispensing member, the closure portion connected on a bottom side to at least one extension member connected to a locking member wherein the locking member has at least one opening for receiving a locking protrusion on the bottle neck, the locking member further having at least one guide member for engaging at least one guide protrusion on the bottle neck.

27. A device for non-removably attaching a dispenser adopted to be connected with a bottle, a fastening member threadably attached to an additional fastening member, the additional fastening member non-removably attached to said bottle, the fastening member attached to a bracket member including a closure portion attached to a dispensing member on a top side of the closure portion and the closure portion having at least one pathway connected to the dispensing member, the closure portion connected on a bottom side to at least one extension member connected to a locking member wherein the locking member has at least one opening for receiving a locking protrusion on the bottle neck, the locking member further having at least one guide member for engaging at least one guide protrusion on said bottle neck.

* * * * *

UNITED STATES PATENT AND TRADEMARK OFFICE

CERTIFICATE OF CORRECTION

PATENT NO. : 6,772,914 B2
DATED : August 10, 2004
INVENTOR(S) : Curtis H. Hubmann et al.

It is certified that error appears in the above-identified patent and that said Letters Patent is hereby corrected as shown below:

Title page,
Item [75], Inventors, replace "Add the following named inventor" with -- Dean R. Maune --.
Item [57], ABSTRACT,
Line 1, replace "device for a non-removably" with -- device for non-removably --.

Column 4,
Line 54, replace "a:" with -- at --.

Signed and Sealed this

Eighth Day of November, 2005

JON W. DUDAS
*Director of the United States Patent and Trademark Office*

UNITED STATES PATENT AND TRADEMARK OFFICE

CERTIFICATE OF CORRECTION

PATENT NO. : 6,772,914 B2
APPLICATION NO. : 10/037569
DATED : August 10, 2004
INVENTOR(S) : Hubmann et al.

It is certified that error appears in the above-identified patent and that said Letters Patent is hereby corrected as shown below:

Title Page, Item (75) Inventors should read

--(75) Inventors: Curtis H. Hubmann, Racine, WI (US); Matthew E. Young, Cambs (GB); Simon R. Gainey, Wayne, PA (US); Mark D. Gerhart, Westminster, MD (US); Dean R. Maune, Franklin, WI (US);--.

Signed and Sealed this
First Day of December, 2015

Michelle K. Lee

Michelle K. Lee
*Director of the United States Patent and Trademark Office*